United States Patent [19]

Fujitani et al.

[11] 4,109,461

[45] Aug. 29, 1978

[54] METHOD FOR OPERATING INTERNAL COMBUSTION ENGINE

[75] Inventors: Yoshiyasu Fujitani; Hideaki Muraki, both of Nagoya, Japan

[73] Assignee: Kabushiki Kaisha Toyota Chuo Kenkyusho, Japan

[21] Appl. No.: 674,630

[22] Filed: Apr. 7, 1976

[30] Foreign Application Priority Data

Apr. 7, 1975 [JP] Japan ..... 50-42534

[51] Int. Cl.[2] ..... F01N 3/08

[52] U.S. Cl. ..... 60/274; 123/3

[58] Field of Search ..... 123/3 X, 59 EC, 1 A; 60/274, 303; 48/212

[56] References Cited

U.S. PATENT DOCUMENTS

| | | | |
|---|---|---|---|
| 3,732,696 | 5/1973 | Masaki | 60/274 |
| 3,828,736 | 8/1974 | Koch | 123/3 |
| 3,855,980 | 12/1974 | Weisz et al. | 123/3 |
| 3,871,838 | 3/1975 | Henkel et al. | 123/3 |
| 3,915,125 | 10/1975 | Henkel et al. | 123/3 |
| 3,918,412 | 11/1975 | Lindstrom | 123/3 |
| 3,955,538 | 5/1976 | Noguchi et al. | 123/3 |
| 3,976,034 | 8/1976 | Shinohara et al. | 123/3 |

*Primary Examiner*—Martin P. Schwadron
*Assistant Examiner*—G. L. Walton
*Attorney, Agent, or Firm*—Oblon, Fisher, Spivak, McClelland & Maier

[57] ABSTRACT

This invention relates to a method of operating an internal combustion engine which comprises placing a reaction cylinder filled with a catalyst for partially oxidizing a hydrocarbon-base fuel within an exhaust gas passage, feeding a mixture gas consisting of hydrocarbons and a gas which contains oxygen of a quantity providing an "oxygen-to-carbon ratio" of 0.3 to 1.2 into the reaction cylinder, partially oxidizing the hydrocarbons into a reformed gas which consists essentially of $H_2$ and CO in the temperature range of 800° to 1200° C, mixing the reformed gas and a gas containing oxygen of a quantity providing "an excess oxygen ratio" of 1.1 to 2.0, and feeding this mixed gas into an intake manifold of the internal combustion engine.

5 Claims, 2 Drawing Figures

METHOD FOR OPERATING INTERNAL COMBUSTION ENGINE

BACKGROUND OF THE INVENTION

1. Field of the Invention

This invention relates to a method of operating an internal combustion engine which enables improved purification or conversion of the exhaust gases thereof.

2. Brief Description of the Prior Art

It is known that nitrogen oxides and inflammable gases, such as carbon monoxide, hydrocarbons and the like, that is, harmful gases, are contained in the exhaust gases which are being exhausted from the internal combustion engines of motor vehicles. Accordingly, various attempts have been made to prevent such harmful gases from being discharged into the atmosphere.

Among the many improvements in this field which have heretofore been provided for avoiding the discharge of such harmful gases is one in which liquid fuel, such as gasoline or the like, is reformed into a reformed gas consisting essentially of hydrogen and carbon monoxide, with which a great amount of air is then mixed so as to provide a lean mixture gas, and then the mixture gas, thus prepared, is fed into an internal combustion engine for so-called "lean burning." This lean burning results in lowering of the combustion temperature within the engine, thereby enabling the quantity of nitrogen oxide to be lowered to a value as low as about 100 to 20 ppm. However, in this lean burning, a relatively great amount of unburned gases, such as unburned carbon monoxide and hydrocarbons and the like, which are residual in the aforesaid reformed gas, remains in the exhaust gases. For instance, about 0.2% of carbon monoxide and about 500 ppm. of hydrocarbons remains, which constitutes a disadvantage of such lean burning.

SUMMARY OF THE INVENTION

Accordingly, it is an object of the present invention to provide a method of operating an internal combustion engine which enables improved purification or conversion of the exhaust gases being emitted therefrom.

It is another object of this invention to provide a method of operating an internal combustion engine in which nitrogen oxides and inflammable gases, such as carbon monoxide, hydrocarbons and the like, that is, harmful gases, are not discharged into the atmosphere.

Still another object of this invention is to provide a method of operating an internal combustion engine at a high efficiency by improving the reformed-gas production and combustion efficiency of the engine.

A further object of this invention is to provide an improved method of operating an internal combustion engine with so-called "lean burning" and converting the exhaust gases to non-harmful gases.

The present invention is therefore directed to overcoming the aforesaid disadvantages by improving the reformed-gas production and combustion efficiency of an engine by efficiently removing the inflammable gases, such as carbon monoxide, hydrocarbons and the like, contained in exhaust gases.

The foregoing objects and others are attained according to the present invention by sealingly placing a reaction cylinder in a passage of exhaust gases from an internal combustion engine, which cylinder is filled with a catalyst for use in partially oxidizing hydrocarbon for the purpose of permitting heat exchange between the fluid flowing through the reaction cylinder and the exhaust gases. Then, a mixture gas consisting of hydrocarbon-base fuel and gas which contains oxygen of a quantity providing an oxygen-to-carbon ratio of 0.3 to 1.2, is fed into the reaction cylinder to partially oxidize the fuel into a reformed gas which contains hydrogen ($H_2$) and carbon monoxide (CO) as a main ingredient and a small amount of a low grade hydrocarbon. The partial oxidation is carried out at a temperature of 800° C. to 1200° C. Thereafter, gas which contains oxygen of a quantity providing an oxygen ratio of 1.1 to 2.0 is mixed with the aforementioned reformed gas, and this mixed gas is then fed into an internal combustion engine. As a result, the oxidation heat produced due to the aforedescribed partial oxidation is imparted to the aforementioned exhaust gases, thereby burning and removing inflammable gases, such as CO, HC and the like contained in the exhaust gases.

BRIEF DESCRIPTION OF THE DRAWINGS

Various other objects, features and attendant advantages of the present invention will be more fully appreciated as the same becomes better understood from the following detailed description, when considered in connection with the accompanying drawings, in which.

DETAILED DESCRIPTION OF THE PREFERRED EMBODIMENTS

Figure 1:
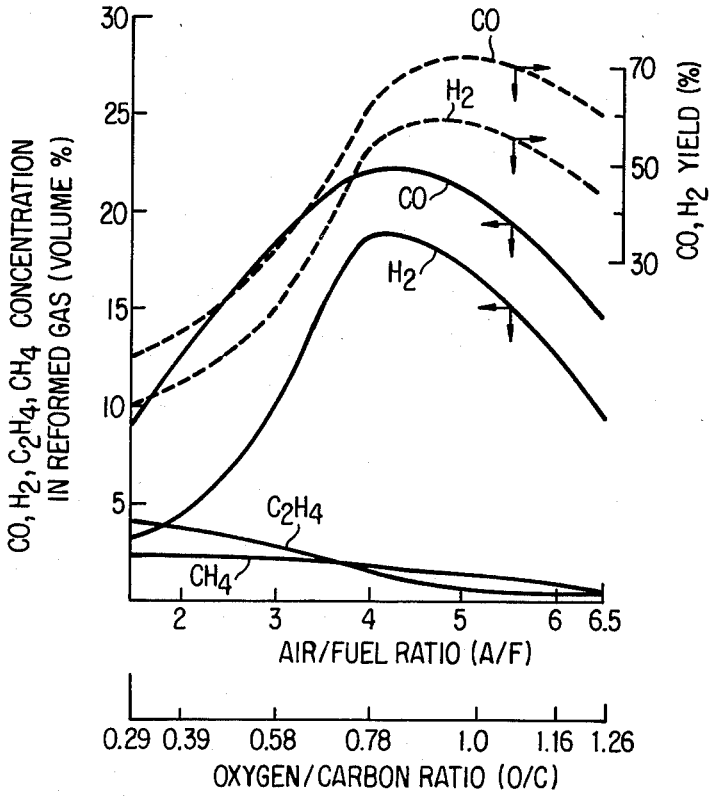
FIG. 1 is a plot showing the relationship between the oxygen-to-carbon ratio and the amount of reformed gases.

Thus, according to the present invention, a hydrocarbon-base fuel is fed, together with gas which contains oxygen of a quantity providing an oxygen-to-carbon ratio of 0.3 to 1.2, into the reaction cylinder, so that the fuel can be partially oxidized into a reformed gas consisting essentially of $H_2$ and CO in an efficient manner. Then, such a reformed gas is fed into an internal combustion engine, together with gas which contains oxygen of a quantity providing an excess oxygen ratio of 1.1 to 2.0, so that explosion and combustion can take place in the internal combustion engine at a high efficiency, thereby maintaining a high combustion efficiency for the engine. In addition, according to the present invention, the reaction cylinder is placed in a passage of exhaust gases from the internal combustion engine, so that the reaction heat produced within the reaction cylinder is transmitted through the outer wall of the reaction cylinder into the exhaust gases, with the result that the CO residual in the exhaust gases and the unburned HC therein are heated to a high temperature due to the aforedescribed heat transmission of the reaction heat. As a result, these gases, such as CO and HC, are burned and removed by the oxygen which is residual in the exhaust gases. Furthermore, the internal combustion engine is run under the lean mixture charge condition (lean burning), so that the explosion and combustion temperature in the internal combustion engine can be maintained relatively low, with the resulting production of little quantity of nitrogen oxide. For these reasons, the present invention can provide an internal combustion engine which discharges non-harmful exhaust gases into the atmosphere.

In the present invention, catalysts which are employable for partial oxidation include a rhodium catalyst, a lanthanum-cobalt catalyst, a nickel catalyst, a cobalt catalyst and the like. As described earlier, the reaction cylinder filled with the catalyst is placed in an exhaust gas passage of an internal combustion engine. Although the position of the reaction cylinder is not limitative, it is preferable that the reaction cylinder be placed in a manifold through which exhaust gases are exhausted from an internal combustion engine. This is due to the reason that the temperature of exhaust gases within the manifold is considerably high and by imparting reaction heat from the reaction cylinder to such exhaust gases of high temperature, inflammable gases, such as CO, HC and the like, can be burned and removed. It is also preferable, for improving transmission of heat from the reaction cylinder to exhaust gases, to provide a plurality of reaction cylinders, or that radiating fins be provided on the outer walls of the reaction cylinders.

Hydrocarbons for use in the aforementioned hydrocarbon-base fuel include those in the group consisting of carbon and hydrogen, for instance, gasoline, naphtha, medium grade oil and the like. In this respect, upon feeding such fuel to the reaction cylinder, the fuel is rendered gaseous and then gas, which contains oxygen, such as air, is mixed therewith. This oxygen serves as an oxidizer for partial oxidation. The quantity of oxygen to be mixed with the hydrocarbon ranges from 0.3 to 1.2 in terms of an oxygen-to-carbon ratio. The term "an oxygen-to-carbon ratio" as used herein is the ratio (O/C) of the number of oxygen atoms contained in a molecule of oxygen to the number of carbon atoms contained in a molecule of hydrocarbon of the aforementioned hydrocarbon-base fuel. Accordingly, assume that the hydrocarbon $C_7H_{11}$ of 1 mol is used and oxygen is supplied at an oxygen-to-carbon ratio of 1.0, then oxygen of 3.5 mol should be supplied to the hydrocarbon.

Oxygen to be mixed with the hydrocarbon may be oxygen gas alone, air, oxygen gas and air, or gases containing oxygen. However, when air is used, air of 5 times the quantity as that of oxygen should be mixed with the hydrocarbon, because about 20% oxygen ($O_2$) is contained in air. The reason why an oxygen-to-carbon ratio is defined as ranging from 0.3 to 1.2 is due to the fact that if the oxygen-to-carbon ratio is less than 0.3, there results a shortage of oxygen, so that the hydrocarbon is carbonized at the high temperature of the catalyst in the reaction cylinder. As a result, there is a risk of catalyst activity being lowered. On the other hand, if the ratio is more than 1.2, there results excessive oxidation of hydrocarbon, so that inflammable gases (CO, $H_2$ and low grade hydrocarbons, such as $CH_4$, $C_2H_4$ and the like) contained in a reformed gas to be fed into an internal combustion engine are reduced in quantity.

In the reaction cylinder, hydrocarbon is partially oxidized by oxygen, so that a majority of the hydrocarbon is converted into a reformed gas consisting essentially of CO and $H_2$. In this case, it is quite difficult to completely partially oxidize hydrocarbon into CO and $H_2$. Thus, a part of the hydrocarbon is decomposed into low grade hydrocarbons having a carbon number of 1 to 4, such as, for instance, methane, ethylene, propylene, butylene and the like, which are contained in a reformed gas. The fact that these low grade hydrocarbons are contained in a small amount in a reformed gas improves the running condition of an internal combustion engine.

Before feeding the reformed gas into an internal combustion engine, oxygen is mixed with the reformed gas for explosion and burning of the reformed gas therein. The ratio in quantity of oxygen to be mixed with that of the reformed gas ranges from 1.1 to 2.0 in terms of the excess oxygen ratio. The term "excess oxygen ratio" herein is a ratio (A) of oxygen to inflammable gases, such as CO, $H_2$ and residual hydrocarbons, contained in the reformed gas, assuming that the ratio (B) of the quantity of oxygen necessary for completely burning inflammable gases to that of the inflammable gases is 1.0. For example, when the ratio (B) of the quantity of oxygen necessary for completely burning the inflammable gases to that of the inflammable gases is 3.0 and the ratio (C) of the quantity of oxygen really added into the inflammable gases to that of this inflammable gases is 4.5, "excess oxygen ratio," that is, the above mentioned ratio (A), is 1.5. The excess oxygen ratio 1.5 is obtained by calculating 4.5/3.0, or ratio (C)/ratio (B). In other words, "excess oxygen ratio" is ratio (C) to ratio (B). The reason why an excess oxygen ratio is defined to the aforesaid range (1.1 to 2.0) is as follows. Namely, when the excess oxygen ratio exceeds 2.0, there results a shortage of fuel, with the result of low explosion and combustion speed, and a low output efficiency of the engine. On the other hand, when the excess oxygen ratio is less than 1.1, there results an increase in the combustion temperature in the internal combustion engine, with the resulting increase in quantity of NOx. Oxygen to be mixed with the reformed gas may be oxygen gas alone, air, oxygen gas and air, or gases containing oxygen.

The temperature of a catalyst layer during the aforedescribed partial oxidation should be maintained between 800° and 1200° C. If the temperature is lower than 800° C., a lower reaction speed results, with resulting failures to achieve sufficient partial oxidation. On the other hand, if the temperature exceeds 1200° C., deterioration of the catalyst is advanced. The adjustment of the temperature is accomplished by feeding an inert gas, such as nitrogen, into a reaction cylinder to control the partial oxidation, or by providing a heating source, such as an electric heater, in the catalyst layer. However, in the practical application, exhaust gases are heated to between 300° and 700° C., so that there is little possibility of an abnormal temperature rise in the catalyst layer due to heat being radiated from the wall of the reaction cylinder into the exhaust gases. Meanwhile, the aforementioned partial oxidation is a high exothermic reaction, for instance, if gasoline is taken as an example, heat of about 2 Kcal is produced from 1cc. of gasoline. For this reason, there is little possibility that the temperature of the catalyst layer is lowered to below 800° C. during running of the internal combustion engine.

For the foregoing reasons, the temperature of a reaction cylinder can be maintained in a range of 800° to 1200° C. The temperature of exhaust gases exhausted from the internal combustion engine is about 500° C. within the manifold, so that the exhaust gases are heated by the heat from the reaction cylinder to 800° to 1000° C. Accordingly, inflammable gases present in exhaust gases will be burned and removed by oxygen residual in the exhaust gases.

A test example and embodiments according to the present invention are illustrated as follows:

TEST EXAMPLE

Rhodium catalyst was used as a catalyst for partial oxidation, while air, as a gas which contains oxygen, was added to gasoline, as a hydrocarbon. Then, partial oxidation of the gasoline as a hydrocarbon was carried out under various condition, to obtain reformed gases, followed by measurement of the compositions of the reformed gases thus obtained.

The aforesaid rhodium catalyst was obtained by immersing a spherical α-alumina-magnetia carrier of about 3mm in diameter into a rhodium chloride solution, followed by drying and baking. Thus, the rhodium catalyst has 0.1% by weight of rhodium carried on the carrier.

For partial oxidation, the rhodium catalyst thus obtained was filled into a quartz cylinder type converter, having an inner diameter of about 30 mm, and then a mixture gas of gasoline (average composition $C_7H_{14.4}$) and air was fed into the catalyst layer. In this respect, gasoline was gasified at a temperature of about 250° C. beforehand and then mixed with air. The test was carried out at various carbon-to-oxygen ratios. Namely, in this test, the amount of air to the constant amount of gasoline (air-fuel ratio, A/F) is varied. In addition, the amount of gasoline to be fed to the catalyst layer was 10 or 20 in terms of LHSV. The temperature of the catalyst layer was adjusted to a range of 800° to 1100° C. The term "air-fuel ratio" as used herein is the ratio of the amount, by weight, of air to the amount, by weight, of gasoline being fed to the catalyst layer. The air-fuel ratio was derived by multiplying the oxygen-to-carbon ratio 5.14 times. The term "LHSV (Liquid Hourly Space Velocity)" is a liquid-equivalent amount (cc) of gasoline passing through the catalyst layer of unit capacity (cc) in an hour. The test results are shown in Table 1.

Table 1

| | | | | | | | | | |
|---|---|---|---|---|---|---|---|---|---|
| oxygen-to-carbon ratio (%) | | 0.29 | 0.39 | 0.49 | 0.58 | 0.78 | 0.97 | 1.16 | 1.26 |
| air fuel ratio (A/F) | | 1.5 | 2.0 | 2.5 | 3 | 4 | 5 | 6 | 6.5 |
| LHSV (cc/cc. hour) | | 20 | 20 | 20 | 20 | 10 | 10 | 10 | 10 |
| change rate (%) | | 90.2 | 92.8 | 97.9 | 99.7 | 100 | 100 | 100 | 100 |
| | $H_2$ | 3.0 | 4.3 | 6.2 | 9.4 | 19.3 | 17.8 | 13.6 | 10.0 |
| com- | CO | 9.0 | 12.4 | 15.4 | 17.6 | 22.6 | 21.1 | 17.6 | 15.0 |
| position | $CH_4$ | 2.5 | 2.4 | 2.2 | 2.0 | 1.9 | 1.5 | 1.0 | 0.6 |
| of | $C_2H_4$ | 4.0 | 3.9 | 3.3 | 3.2 | 1.5 | 0.9 | 0.5 | 0.3 |
| reformed | $C_3H_6$ | 2.3 | 2.2 | 1.7 | 1.4 | 0.6 | 0.3 | 0.2 | 0.1 |
| gas | $C_4H_8$ | 2.7 | 2.5 | 2.4 | 1.4 | 0.5 | 0.2 | 0.1 | — |
| (volume | $CO_2$ | 1.1 | 1.2 | — | — | 1.0 | 1.3 | 3.7 | 5.3 |
| %) | $H_2O$ | 12.9 | 12.7 | 10.8 | 9.0 | 2.3 | 5.8 | 6.7 | 7.2 |
| | $N_2$ | 52.8 | 51.7 | 54.0 | 53.4 | 49.4 | 50.6 | 56.4 | 60.5 |
| catalyst temperature (° C) | | 800 | 830 | 860 | 880 | 865 | 910 | 990 | 1050 |

The term "change rate (%)", as referred to in Table 1, denotes the percentage of gasoline changed to materials other than gasoline. Meanwhile, in the reformed gas, a mixture gas, of such as ethylene, propane, butane, hydrocarbon of carbon number of 5, was found other than the composition shown in Table 1.

Referring now to the drawings, and more particularly to FIG. 1, the oxygen-to-carbon ratio (O/C) and air-fuel ratio (A/F) are represented by an abscissa, while the concentrations (volume %) of CO, $H_2$ and $CH_4$ and $C_2H_4$ shown in Table 1 are represented by a left ordinate. In addition, the yield percent of CO and $H_2$ are shown by a right ordinate. The yield percent as used herein is the ratio (%) of the quantities of CO and $H_2$ which have been actually obtained to the quantities of those which are to be obtained from gasoline theoretically. The respective curves shown in FIG. 1 represent the quantities of the gases CO, $H_2$, $CH_4$ and $C_2H_4$.

As is clear from FIG. 1, a great amount of $H_2$ and CO is contained in a reformed gas, except for $N_2$ which has been contained in air, and a small amount of low grade hydrocarbons is also contained in the reformed gas. In addition, if the oxygen-to-carbon ratio is less than 0.3, there results a considerable lowering in the yield percent of desired CO and $H_2$. On the other hand, if the oxygen-to-carbon ratio is over 1.2, there results a remarkable reduction in the yield percent of CO and $H_2$, and there is noted an increase in the quantities of $CO_2$ and $H_2O$, which represent progress of complete combustion of the hydrocarbons.

Hereinafter, embodiments according to the present invention will be described, in which the present invention is applied to operating the internal combustion engine of a motor vehicle.

Figure 2:
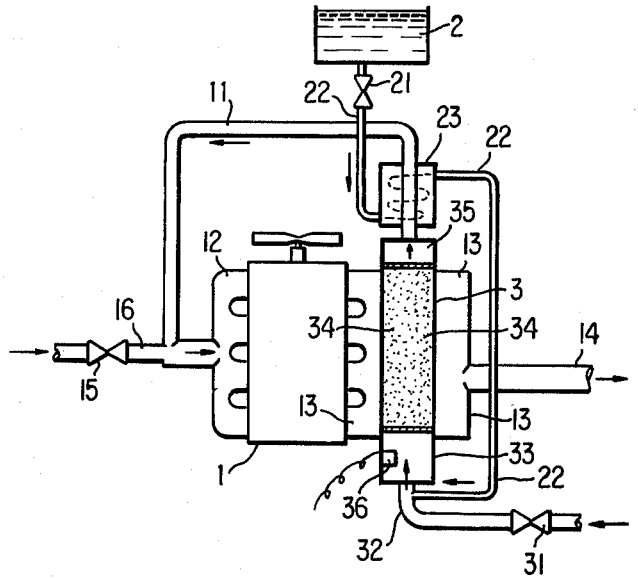
FIG. 2 is a view illustrative of an exhaust-gas-converting apparatus used in practicing the method embodiments of the present invention.

The apparatus used in the following embodiments 1 and 2 is shown in FIG. 2. More particularly, a reaction cylinder 3 is placed within an exhaust gas manifold 13, to which an air supply pipe 32 is connected through a gas inlet portion 33. A reformed gas feeding pipe 11 for the internal combustion engine 1 is connected to an intake manifold 12 of the engine 1. The reaction cylinder 3 is filled with a catalyst 34 to be used for partial oxidation. A heat exchanger 23 is provided around the outer periphery of one portion of the reformed gas feeding pipe 11 for the purpose of preheating liquid fuel, a liquid fuel supply pipe 22 being open into the gas inlet portion 33 of the reaction cylinder 3 and being connected to a liquid fuel tank 2 through the heat exchanger 23. An air feeding pipe 16 for feeding air for combustion is connected to the reformed gas feeding pipe 11 in the vicinity of the intake manifold 12. Shown at 15, 21, and 31 are valves, at 14 an exhaust pipe, and at 36 a spark plug for use in burning the liquid fuel, so as to heat the catalyst layer 34 upon starting of the internal combustion engine.

Upon operating the internal combustion engine with the aforesaid apparatus, liquid fuel is supplied through the liquid fuel supply pipe 22 to the gas inlet portion 33 of the reaction cylinder 3, while air, as a gas which contains oxygen, is supplied thereto through the air supply pipe 32, so that a mixture gas of air and gaseous liquid fuel is fed to the catalyst layer 34 maintained at a high temperature, thereby partially oxidizing the liquid fuel into a reformed gas under the action of the catalyst. Then, the reformed gas flowing through the pipe 11 is mixed with air which is being supplied through the pipe 16 for combusting the reformed gas, and the mixture thus obtained is fed through the intake manifold 12 into the internal combustion engine for driving the engine. In this respect, a great amount of heat generated due to the partial oxidation is transmitted through the outer wall of the reaction cylinder 3 to exhaust gases in the exhaust manifold, thereby burning and removing inflammable gases, such as CO, hydrocarbon and the like, which are residual in such exhaust gases. In this case, the liquid fuel is preheated by means of the heat exchanger 23 to facilitate its gasification at the gas inlet portion 33. Meanwhile, upon starting of the apparatus, a mixture gas of air and gaseous fuel is ignited by the spark plug 36 for burning the same, thereby preheating the catalyst layer, as has been described earlier.

EMBODIMENT 1

The operational conditions and results are as follows.

(a) Type of internal combustion engine used herein, and its driving condition:
- Piston type;
- capacity — 1588 cc;
- compression ratio — 8.5;
- engine speed — 1500 rpm;
- intake throttle valve fully opened;
- spark timing — 37° BTDC (MPT) (maximum torque condition);
- torque — 5.7 kg-m;
- air quantity for combustion — 570 lit./min;
- excess oxygen ratio — 1.5

(b) Reaction cylinder condition:
- Feeding rate of gasoline (composition $C_7H_{14.4}$) as a liquid fuel — 128 cc/min;
- quantity of air — 295 lit./min;
- oxygen-to-carbon ratio (O/C) — 0.78;
- catalyst — 0.1% by weight of rhodium carried on α-alumina-magnetia carrier of particle size of 3 mm;
- amount of catalyst — 500 cc;
- size of catalyst layer - diameter 6 cm. length 17.5 cm;
- LHSV — about 16 (1/hour);
- temperature of the center of a catalyst layer - 1010° C.
- temperature at the wall of a reaction cylinder - 800° C.

(c) Results:
- Composition of reformed gas produced in the reaction cylinder (volume %) — $H_2$—19%, CO—23%, $CH_4$—1.9%, $CO_2$—1.0%, $H_2$—0.23%, $N_2$—49.4%, others ($C_2H_4$, $C_3H_6$ and the like)—3.4%:
- amount of reformed gas — 380 lit./min;
- amount of exhaust gases from the internal combustion engine — 1200g/min.

The temperature of the exhaust gases and the amount of NOx, HC, CO contained in the exhaust gases are shown in Table 2. In this respect, the amount of such gases is value equivalent to that at 20° C.

Table 2

| | outlet of internal combustion engine | outlet of exhaust manifold |
|---|---|---|
| Gas temperature (° C) | 540 | 800 |
| NOx (g/PS.hr) | 4 | 4 |
| HC (g/PS.hr) | 5 | 2 |
| CO (g/PS.hr) | 5 | 3 |

The term "g/PS.hr" is the amount (g) of harmful gases exhausted per hour per 1 Hp (PS) of an internal combustion engine.

EMBODIMENT 2

The aforesaid apparatus was operated by varying running conditions of an internal combustion engine and reaction conditions of the reaction cylinder. Those conditions and results are as follows:

(a) Drive condition of an internal combustion engine used herein:
- Piston type;
- capacity — 1588 cc;
- compression ratio — 8.5;
- engine speed — 1500 rpm;
- intake manifold pressure — 198 mmHg;
- spark timing — 60° BTDC;
- torque — 2.6 kg-m;
- quantity of air to be used for combustion — 154 lit./-min;
- excess oxygen ratio — 1.65.

(b) Condition of reaction cylinder:
- Feeding rate of gasoline ($C_7H_{14.4}$) — 30 cc/min;
- quantity of air — 77 lit./min;
- oxygen-to-carbon ratio (O/C) — 0.88;
- catalyst — 4% by weight of lanthanum and 1.5% by weight of cobalt carried on the carrier as in the first embodiment;
- amount of catalyst — 500cc;
- LHSV — 3.6 (1/hour);
- temperature of the center of a catalyst layer — 900° C.;
- temperature at the wall of a reaction cylinder — 800° C.;
- size of catalyst layer — the same as that of the Embodiment 1.

(c) Results
- Composition of reformed gas — $H_2$—13.1%, CO—13.1%, $CH_4$—2.1%, $C_2H_4$—3.3%, $CO_2$—5.4%, $H_2O$—5.0%, $N_2$—54.3%, others (Hydrocarbons of $C_2$ to $C_5$)—3.7%;
- amount of reformed gas — 93.5 lit./min;
- quantity of exhaust gases from internal combustion engine — 233 lit/min;
- temperature of exhaust gases and amounts of NOx, HC and CO contained in the exhaust gases are as shown in Table 3.

Table 3

| | outlet of internal combustion engine | outlet of exhaust manifold |
|---|---|---|
| Gas temperature (° C) | 450 | 750 |
| NOx (g/PS.Hr) | 0.8 | 0.8 |
| HC (g/PS.Hr) | 8.1 | 1.0 |
| CO (g/PS.Hr) | 7.0 | 3.0 |

Meanwhile, when, according to the conventional method without reforming gasoline, gasoline was atomized and fed into the foregoing internal combustion engine, together with air, NOx (7g/PS.hr), HC (7g/PS.hr), and CO (45g/PS.hr) were contained in the exhaust gases under the normal running condition of the engine (air-fuel ratio 14.7 to 16). This case shows that the exhaust gases of the engine contain a great amount of harmful gases in the conventional methods.

As is apparent from the foregoing description, an internal combustion engine may be operated according to the present invention in a condition where an extremely small amount of NOx, HC and CO is contained in the exhaust gases being discharged to the atmosphere.

Thus, according to the present invention, the reaction heat produced due to the partial oxidation is imparted to the exhaust gases, so that inflammable gases, such as carbon monoxide and hydrocarbon residual, in the exhaust gases are burned and converted to water and carbon dioxide, or non-harmful gases. In addition, a hydrocarbon-base fuel can be partially oxidixed into a reformed gas consisting essentially of CO and $H_2$ at a high efficiency, and explosion and combustion can take place in the internal combustion engine with high efficiency.

Obviously, many modifications and variations of the present invention are possible in light of the above teachings. It is therefore to be understood that within the scope of the appended claims the invention may be practiced otherwise than as specifically described herein.

What is claimed as new and desired to be secured by letters patent of the United States is:

1. A method of operating an internal combustion engine comprising the steps of:

placing a reaction cylinder within a passage of exhaust gases being exhausted from an internal combustion engine in sealing relation therewith for the purpose of imparting heat produced in said reaction cylinder to said exhaust gases being exhausted from the engine, said reaction cylinder being filled with a rhodium catalyst for use in partially oxidizing hydrocarbons;

feeding into said reaction cylinder a mixture gas consisting of a hydrocarbon-base fuel and gas which contains oxygen of a quantity providing an oxygen-to-carbon ratio of 0.3 to 1.2;

partially oxidizing said fuel into a reformed gas for lean burn which contains 4.3 to 19.3% of hydrogen, 12.4 to 22.6% of carbon monoxide and 1.0 to 2.4% of methane in a temperature range of 800° C. to 1200° C. to produce reaction heat for maintaining said reaction cylinder in said temperature range;

mixing said reformed gas and a gas containing oxygen of a quantity providing an excess oxygen ratio of 1.1 to 2.0 to obtain a lean mixture gas for lean burn;

feeding said lean mixture gas into said internal combustion engine to operate the engine under such a lean mixture condition as to lower the quantity of nitrogen oxide produced in the exhaust gases;

exhausting exhaust gases to said passage of exhaust gases, which gases contain inflammable gases such as carbon monoxide and hydrocarbon produced due to said lean burn; and heating said exhaust gases during their passing through said passage of exhaust gases to burn said inflammable gases residual in said exhaust gases by heat from the reaction cylinder which is placed within said passage of exhaust gases and which is maintained in said temperature range of 800° C. to 1200° C.;

whereby pure exhaust gases can be discharged into the atmosphere containing minimal amounts of harmful gases such as nitrogen oxide, carbon monoxide and hydrocarbons.

2. The method of claim 1, wherein said hydrocarbon-base fuel is selected from the group consisting of gasoline, naphtha and medium grade oil.

3. The method of claim 1, wherein said reformed gas contains methane, ethylene, propylene, butylene and a mixture thereof.

4. The method of claim 1, wherein said gas which contains oxygen of a quantity providing an oxygen-to-carbon ratio of 0.3 to 1.2 is selected from the group consisting of oxygen gas, air and a mixture thereof.

5. The method of claim 1, wherein said gas containing oxygen of a quantity providing an excess oxygen ratio of 1.1 to 2.0 is selected from the group consisting of oxygen gas, air, and a mixture thereof.

* * * * *